US006275130B1

(12) United States Patent
Yoshimura et al.

(10) Patent No.: US 6,275,130 B1
(45) Date of Patent: Aug. 14, 2001

(54) CORROSION-RESISTING PERMANENT MAGNET AND METHOD FOR PRODUCING THE SAME

(75) Inventors: Kohshi Yoshimura, Amagasaki; Takeshi Nishiuchi, Ibaraki; Fumiaki Kikui, Osaka, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/445,810

(22) PCT Filed: Apr. 13, 1999

(86) PCT No.: PCT/JP99/01945

§ 371 Date: Mar. 20, 2000

§ 102(e) Date: Mar. 20, 2000

(87) PCT Pub. No.: WO99/54890

PCT Pub. Date: Oct. 28, 1999

(30) Foreign Application Priority Data

Apr. 16, 1998 (JP) ..... 10-123956

(51) Int. Cl.[7] ..... H01F 7/02
(52) U.S. Cl. ..... 335/302; 428/552
(58) Field of Search ..... 335/302–306; 428/11, 27, 552, 632, 900

(56) References Cited

U.S. PATENT DOCUMENTS 3,799,796 * 3/1974 Hunter ..... 428/627
4,985,313 * 1/1991 Penneck et al. ..... 428/627
5,316,595 5/1994 Hamada et al. .

FOREIGN PATENT DOCUMENTS 59-130406 * 7/1984 (JP) .

* cited by examiner

*Primary Examiner*—Lincoln Donovan
(74) *Attorney, Agent, or Firm*—Dykema Gossett PLLC

(57) ABSTRACT

An object of the present invention is to provide an Fe—B—R permanent magnet that exhibits stabilized high magnetic properties, wear resistance, electrical insulating performance, and corrosion resistance and shows minimized deterioration from the initial magnetic properties when exposed for an extended time to atmospheric conditions of a temperature of 80° C. and relative humidity of 90%, by providing a coating film having outstanding adhesion with the Fe—B—R permanent magnet and improved wear resistance and corrosion resistance. After cleaning the surface of the permanent magnet body by ion sputtering or the like, an Al or Ti coating film is formed on the surface of that magnet body by a vapor film-forming method such as ion plating, and then an aluminum oxide coating film is formed by a vapor film-forming method such as ion plating while introducing either simple $O_2$ gas or a rare gas containing $O_2$. When that is done, the adhesiveness with the coating film is sharply improved and outstanding corrosion resistance properties are realized. Thus, an Fe—B—R permanent magnet is obtained which exhibits stabilized magnetic properties due to the anticorrosive, wear-resistant, and electrically insulating properties of the anticorrosive metallic coating film applied.

10 Claims, No Drawings

CORROSION-RESISTING PERMANENT MAGNET AND METHOD FOR PRODUCING THE SAME

TECHNICAL FIELD

This invention relates to an Fe—B—R permanent magnet provided with an anticorrosive coating film, exhibiting high magnetic characteristics and adhesion, outstanding corrosion resistance, acid resistance, alkaline resistance, wear resistance, and electrical insulating properties, and relates more particularly to an anticorrosive permanent magnet, and fabrication method therefor, wherewith an Fe—B—R permanent magnet having extremely stable magnetic properties and high corrosion resistivity which shows little deterioration from its initial magnetic properties even when exposed for an extended time to an atmosphere of 80° C. temperature and 90% relative humidity is obtained by providing an aluminum oxide coating layer to a specific thickness on the magnet surface, with an Al or Ti coating layer interposed therebetween.

BACKGROUND ART

Fe—B—R permanent magnets containing B and Fe as their main components and no high-cost Sm or Co which are obtained by using light rare earth elements such as Nd and Pr which are plentiful resources have already been proposed as new high-performance permanent magnets that greatly exceed the maximum performance of conventional rare earth cobalt magnets (Japanese Patent Laid-open No. S59-46008/1984 and Japanese Patent Laid-open No. S59-89401/1984.)

The magnet alloys noted above have a Curie temperature ranging generally from 300° C. to 370° C. By replacing some of the Fe with Co, however, an Fe—B—R permanent magnet is obtained having a higher Curie temperature (Japanese Patent Laid-open No. S59-64733/1984, Japanese Patent Laid-open No. S59-132104/1984).

Also proposed is a Co-containing Fe—B—R permanent magnet that exhibits a Curie temperature that is at least as high as the Co-containing Fe—B—R permanent magnet noted above, and a higher (BH)max, wherein, in order to enhance the temperature characteristics, and especially to improve the iHc, at least one heavy rare earth element such as Dy or Tb is contained as the rare earth element (R) in some of the R in the Co-containing Fe—B—R permanent magnet wherein the R primarily consists of light rare earth elements as Nd and Pr, whereby, while maintaining an extremely high (BH)max of 25 MGOe or greater, iHc is raised higher (Japanese Patent Laid-open No. S60-34005/1985).

There are problems, however, in that the permanent magnets noted above, which are made from Fe—B—R magnetic anisotropic sintered bodies exhibiting outstanding magnetic properties, have a peculiar composition and structure, wherein the primary components are iron and rare earth elements that readily oxidize in air, wherefore, when they are built into magnetic circuits, due to oxides that are produced on the surface of the magnets, magnetic circuit output decline and variation between magnetic circuits are induced, and peripheral equipment is contaminated by the separation of the oxides from the magnet surfaces.

Thereupon, a permanent magnet has been proposed (in Japanese Patent Publication No. H3-74012/1991) wherein the surface of the magnet body is coated with an anticorrosive metal plating layer, by either an electrolytic or non-electrolytic plating method, in order to improve the anticorrosion performance of the Fe—B—R magnets noted above.

With these plating methods, however, the permanent magnet body is a porous sintered body, wherefore, in a pre-plating process, acidic solution or alkaline solution remains in the pores, giving rise to fears of degradation over time and corrosion, and the chemical resistance of the magnet body deteriorates, wherefore the magnet surface is corroded during plating so that adhesion and anticorrosion performance are impaired.

Even when the anticorrosive plating layer is provided, in anticorrosion tests in which samples are exposed to a temperature of 60° C. and relative humidity of 90% for 100 hours, the magnetic characteristics proved to be very unstable, exhibiting 10% or greater degradation from the initial magnetic characteristics.

For this reason, it has been proposed (in Japanese Patent Publication No. H5-15043/1993) that, in order to improve the anticorrosion performance of Fe—B—R permanent magnets, an ion plating method, ion sputtering method, or vapor deposition method or the like be used to coat the surfaces of the magnets noted above with Al, Ti, or $Al_2O_3$, and the anticorrosion performance thereby improved.

However, the $Al_2O_3$ coating film has a coefficient of thermal expansion and ductility that differ from those of the Fe—B—R magnet bodies, wherefore adhesion is poor and, although the adhesion of the Al and Ti coatings is good, they are highly reactive, so that localized rusting occurs due to the external environment, and their anti-wear performance is also poor.

A method has also been proposed (Japanese Patent Publication No. H6-66173/1994) wherein, in order to improve the anticorrosion performance of the Al layer, the surface is subjected to a chromate treatment after the Al coating film, but the chromate treatment is problematic because it involves the use of 6-valence chromium which is environmentally toxic, and because treatment of the waste liquid is complex.

SUMMARY OF THE INVENTION

An object of the present invention is to improve antiwear and anticorrosive performance by providing a coating film having excellent adhesion with an Fe—B—R permanent magnet substrate, and in particular to provide an Fe—B—R permanent magnet that exhibits stabilized high magnetic properties, wear resistance, electrical insulating performance, and corrosion resistance, with minimized deterioration from the initial magnetic properties when exposed for an extended time to atmospheric conditions of a temperature of 80° C. and relative humidity of 90%.

In order to provide an Fe—B—R permanent magnet exhibiting outstanding stable magnetic characteristics, the inventors conducted various investigations on methods of forming aluminum oxide coating films on permanent magnet surfaces, as an anticorrosive metallic coating film which exhibits outstanding adhesion with the magnet substrate, corrosion resistance, anti-wear, and electrical insulating properties even when exposed for an extended time to atmospheric conditions of a temperature of 80° C. and relative humidity of 90%.

As a result of their assiduous investigations, the inventors discovered that the object noted above can be attained by employing an ion plating method, ion sputtering method or the like, or vapor-phase film-forming method to form a coating film of Al or Ti of a prescribed film thickness, after cleaning the surface of the magnet body by ion sputtering or the like, and thereafter forming an aluminum oxide coating film of a prescribed film thickness using a vapor film-forming method while introducing a gas containing $O_2$ under specific conditions.

More specifically, the inventors perfected the present invention, discovering that the oxide material present on the magnet surface is reduced, either wholly or partially, by a reaction with Al or Ti at the interface with the Al or Ti, and that, by generating an aluminum oxide coating film on the Al or Ti coating film, $AlO_x$ (where $0<x<1$) is generated at the interface between the Al and the aluminum oxide, or, in the case of Ti, a $(Ti—Al)O_x$ (where $0<x<1$) is generated at the interface with the aluminum oxide, whereupon the adhesiveness between the Al or Ti coating layer and the aluminum oxide can be sharply improved.

The present invention is an anticorrosive permanent magnet, and fabrication method therefor, wherewith, after cleaning the surface of an Fe—B—R permanent magnet, the main phase whereof is a tetragonal lattice phase, a coating film of Al or Ti is formed by a vapor film-forming method on the surface of the magnet body to a film thickness of 0.06 μm to 30 μm, after which a coating film layer of aluminum oxide that is mainly amorphous is formed to a film thickness of 0.1 to 10 μm by a vapor film-forming method in an atmosphere that is either simple $O_2$ or a rare gas such as Ar or He containing 10% or more of $O_2$ gas.

BEST MODE FOR CARRYING OUT THE INVENTION

In the present invention, such so-called vapor film formation methods as ion plating, ion sputtering, and vapor deposition can be used as appropriate for the method of forming the Al coating film, Ti coating film, and aluminum oxide coating film on the surface of the Fe—B—R permanent magnet body. However, the ion plating method and reaction ion plating method are preferable in the interest of coating film fineness, uniformity, and coating film formation speed, etc.

It is also desirable that the temperature of the permanent magnet that constitutes the substrate during reaction coating film formation be 200° C. to 500° C. At temperatures below 200° C. the reaction adhesion with the substrate magnet is inadequate, while at temperatures exceeding 500° C. the temperature difference with room temperature (25° C.) becomes larger, whereupon cracks develop in the coating film during the subsequent cooling process, and the coating film peels away from some parts of the substrate. Hence the temperature should be set at 200° C. to 500° C.

In the present invention, the aluminum oxide coating film layer obtained is a compound formed from aluminum and oxygen, the structure is primarily amorphous, whereupon, depending on the reaction conditions, the layer obtained will either be completely amorphous or crystalline material will be present in some places. In the structure that is primarily amorphous, no clear grain boundaries exist, and localized electrochemical reactions that cause corrosion do not readily occur, wherefore the anticorrosive property is superior as compared to crystalline $Al_2O_3$ coating films.

An example of a method of fabricating the anticorrosive magnet of the present invention wherein an aluminum oxide coating film layer is provided with an intervening Al or Ti coating film layer on the surface of an Fe—B—R permanent magnet is now described in detail.

First, using an arc ion plating apparatus, a vacuum vessel is evacuated to produce a vacuum of $1\times10^{-4}$ Pa or lower. Then the surface of the Fe—B—R magnet body is cleaned by Ar-ion surface sputtering with an Ar gas pressure of 10 Pa at −500V.

Next, using an Ar gas pressure of 0.2 Pa and bias voltage of −50 V, the target Al or Ti is vaporized and an Al or Ti coating film layer is formed to a film thickness of 0.06 μm to 30 μm on the surface of the magnet body with an arcion plating method. The ion plating method provides a fast film formation speed, and is the preferred method for forming an Al or Ti coating film of 5 μm or greater.

Following that, an aluminum oxide coating film layer is formed to a prescribed film thickness on the Al or Ti coating film under conditions of $O_2$ gas pressure of 0.8 Pa and bias voltage of −80 V, maintaining the substrate temperature at 250° C.

In the present invention, the reason for limiting the thickness of the Al or Ti coating film on the surface of the Fe—B—R permanent magnet to 0.06 to 30 μm is that, at thicknesses below 0.06 μm it is difficult to make the Al or Ti adhere evenly to the surface of the magnet body, and the effectiveness of the lower film is inadequate, whereas when 30 μm is exceeded there is no problem with effectiveness but the cost of the underlying film rises and becomes impractical. Hence the Al or Ti coating film thickness is made 0.06 to 30 μm.

In particular, the thickness of the Al or Ti coating layer is selected according to the surface roughness of the magnet body. When that surface roughness is 0.1 μm or less, the coating layer thickness should be made 0.06 μm or greater. When that surface roughness is 0.1 to 1.2 μm, the coating layer thickness should be made 0.1 μm or greater.

In the present invention, the reason for limiting the thickness of the aluminum oxide coating layer to 0.1 to 10 μm is that, at thicknesses of less than 0.1 μm, adequate corrosion resistance is not obtained, whereas at thicknesses greater than 10 μm, while there is no problem with effectiveness, the manufacturing costs rise to undesirable levels.

In the present invention, the interface between the Al or Ti coating layer and the aluminum oxide coating layer is a laminar coating layer having an interposing reaction coating layer. In order to obtain adequate corrosion resistance, a configuration may be adopted wherein the thickness of the Al or Ti coating layer is made 5 μm to 30 μm, for example, and the aluminum oxide coating layer is made thin, or, alternatively, the Al or Ti coating film layer is made thin, on the order of 0.06 μm to 5 μm, and the thickness of the aluminum oxide coating film layer is made thicker, on the order of 0.5 μm to 10 μm.

However, in order to obtain outstanding wear resistance and electrical insulating properties, in view of the fact that these properties arise from the aluminum oxide coating film layer, the thickness of the aluminum oxide coating film layer should be made 0.5 μm to 10 μm.

In the present invention, the gas atmosphere containing $O_2$ in the vapor film-forming method is limited to either simple $O_2$ or to a rare gas (i.e. an element in the O group in the periodic table) containing 10% or more of $O_2$ gas. When this is less than 10%, too much time is required for forming the aluminum oxide coating film, wherefore that is undesirable. For industrial reasons, either a simple $O_2$ gas or an Ar gas atmosphere containing $O_2$ gas is generally to be preferred.

In the present invention, the rare earth element R used in the permanent magnet described in the foregoing accounts for 10 atomic % to 30 atomic % of the composition, but it is desirable that this contain either at least one element from among Nd, Pr, Dy, Ho, and Th, or, in addition thereto, at least one element from among La, Ce, Sm, Gd, Er, Eu, Tm, Yb, Lu, and Y. Ordinarily, it is sufficient to have one of the R elements, but in practice, it is possible to use a mixture of two or more elements (misch metal, didymium, etc.) for reason of ease of procurement. This R need not be a pure rare earth element either; there is no problem with it containing impurities as may be unavoidable in manufacture, with a range as can be procured industrially.

R is a mandatory element in the permanent magnets noted above. At lower than 10 atomic %, the crystalline structure becomes a cubic crystal system having the same structure as α-iron, wherefore high magnetic characteristics, especially high coercive force, are not obtained. When 30 atomic % is exceeded, the R-rich nonmagnetic phase increases and residual magnetic flux density (Br) declines, wherefore a permanent magnet exhibiting outstanding characteristics is not obtained. Thus the range of 10~30 atomic % for R is desirable.

B is a mandatory element in the permanent magnets noted above. At lower than 2 atomic %, a rhombohedral structure becomes the main phase, and high coercive force (iHc) is not obtained. When 28 atomic % is exceeded, the B-rich non-magnetic phase increases and residual magnetic flux density (Br) declines, so that outstanding permanent magnets are not obtained. Thus the range of 2~28 atomic % is desirable for B.

Fe is a mandatory element in the permanent magnets noted above. Below 65 atomic %, the residual magnetic flux density (Br) declines. When 80 atomic % is exceeded, high coercive force is not obtained. Thus a range of 65~80 atomic % is desirable for Fe. By replacing some of the Fe with Co, the temperature characteristics can be improved without impairing the magnetic characteristics of the magnets obtained. When the amount of Co replacement exceeds 20% of the Fe, on the other hand, the magnetic characteristics deteriorate, so that is undesirable. When the amount of Co replacement is 5 to 15 atomic % of the total quantity of Fe and Co, Br increases as compared to when there is no substitution, and high magnetic flux density is realized, which is desirable.

In addition to the R, B, and Fe elements, the presence of such impurities as is unavoidable in the course of industrial production is allowable. By substituting at least one element out of C, P, S, and Cu for some of the B, namely C at 4.0 wt % or less, P at 2.0 wt % or less, S at 2.0 wt % or less, and/or Cu at 2.0 wt % or less, for example, such that the total amount of the substitution is 2.0 wt % or less, it is possible to improve permanent magnet productivity and reduce costs.

It is also possible to add at least one element out of Al, Ti, V, Cr. Mn, Bi, Nb, Ta, Mo, W, Sb, Ge, Sn, Zr, Ni, Si, Zn, and Hf, to the Fe—B—R permanent magnet material in order to improve the coercive force, the rectangularity of the demagnetization curve or manufacturing perfomance, or to reduce costs. As to the upper limit of the quantity of such additives, Br must be at least 9 kG or greater in order to get (BH)max of the magnetic material above 20 MGOe, so it should be within a range wherein this condition can be satisfied.

Furthermore, the Fe—B—R permanent magnets are characterized in that the main phase is made a compound having a tetragonal crystalline structure wherein the mean crystal grain diameter is within a range of 1~30 μm, containing a non-magnetic phase (excluding oxide phase) within a volume ratio of 1~50%. Such Fe—B—R permanent magnets exhibit coercive force iHc≧1 kOe, residual magnetic flux density Br>4 kG, and maximum energy product (BH) max≧10 MGOe, with a maximum value of 25 MGOe or higher.

EMBODIMENTS

Embodiment 1

A commonly known cast ingot was crushed and finely pulverized, and then subjected to molding, sintering, heat treatment, and surface treatment to yield magnet body test pieces having the composition 17Nd-1Pr-75Fe-7B, measuring 23×10×6 mm. The magnetic properties thereof are noted in Table 1. Pieces having two types of surface roughness were obtained by surface polishing. The surface roughness is noted in Table 2.

A vacuum vessel was evacuated to produce a vacuum of $1\times10^{-4}$ Pa or below, surface sputtering was conducted for 35 minutes in an Ar gas pressure of 10 pa, at −400 V, and the surface of the magnet body was cleaned. Then, maintaining the substrate magnet temperature at 280° C., under the conditions noted in Table 2, and using a target of metallic Al, arc ion plating was performed to form Al coating film layers of thickness 0.2 μm and 2.0 μm on the magnet body surfaces.

Then, with the substrate magnet temperature at 320° C., the bias voltage at −85 V, the arc current at 88 A, and an $O_2$ gas pressure of 0.7 Pa, arc ion plating was conducted for 3.5 hours to form an aluminum oxide coating film layer of thickness 5 μm on the surface of the Al coating film.

Subsequently, tests were conducted wherein the permanent magnets having aluminum oxide coating film layers obtained by radiation cooling were allowed to stand for 1000 hours under conditions of 80° C. temperature and 90% relative humidity. After this test, the magnetic properties and the deterioration therein were measured. The results are given in Table 3. The aluminum oxide coating films obtained were also subjected to structural analysis using x-ray diffraction, as a result of which the structure was found to be amorphous.

Embodiment 2

Magnet body test pieces having the same composition as in the first embodiment were obtained in two types of surface roughness by surface polishing under the same conditions as in the first embodiment. After surface cleaning under the same conditions as in the first embodiment, arc ion plating was implemented, using metallic Ti as the target, under the same conditions as noted in Table 2, maintaining the substrate magnet temperature at 250° C., to form Ti coating film layers of 0.2 μm and 2.0 μm thickness on the magnet body surfaces.

An aluminum oxide coating film layer was then formed to a thickness of 5 μm under the same conditions as in the first embodiment and, after testing by being allowed to stand for 1000 hours under conditions of 80° C. temperature and 90% relative humidity, the magnetic properties and deterioration therein were measured. The results are noted in Table 3. The aluminum oxide coating films obtained were also subjected to structural analysis using x-ray diffraction, as a result of which the structure was found to be amorphous with crystalline material present in some places.

Embodiment 3

A magnetic body test piece having the same composition as in the first embodiment (with surface roughness of 0.5 μm) was surface-cleaned under the same conditions as in the first embodiment. Then Al wire used as the coating material was heated and vaporized under an Ar gas pressure of 1 Pa with a voltage of 1.5 kV and ionized in an ion plating process for 15 minutes to form an Al coating film layer of 15 μm thickness.

Next, an aluminum oxide coating film layer having a film thickness of 0.5 μm was formed on the Al coating film surface by arc ion plating for 20 minutes with a substrate magnet temperature of 320° C., bias voltage of −85 V, and $O_2$ gas pressure of 0.7 Pa. As a result of structural analysis using x-ray diffraction the aluminum oxide coating film was found to be amorphous.

After the arc ion plating noted above, the permanent magnets having aluminum oxide coating film layers obtained by cooling were allowed to stand for 1000 hours under conditions of 80° C. temperature and 90% relative humidity. After this test, the magnetic properties and the deterioration therein were measured. The results are given in Table 3.

Comparison 1

A magnetic body test piece having the same composition as in the first embodiment (with surface roughness of 0.5 μm) was surface-cleaned under the same conditions as in the first embodiment. Then an aluminum oxide coating film layer of 7 μm thickness was formed on the magnet body under the same reaction conditions as in the first embodiment. After the test piece was allowed to stand for 1000 hours under the same conditions of 80° C. temperature and 90% relative humidity as in the first embodiment, the post-test magnetic properties and deterioration therein were measured. The results are noted in Table 3.

Comparison 2

A magnetic body test piece having the same composition as in the first embodiment (with surface roughness of 0.5 μm) was surface-cleaned under the same conditions as in the third embodiment. Then an aluminum oxide coating film layer of 17 μm thickness was formed on the magnet body under the same reaction conditions for 17 minutes as in the third embodiment. After the test piece was allowed to stand for 1000 hours under the same conditions of 80° C. temperature and 90% relative humidity as in the first embodiment, the post-test magnetic properties and deterioration therein were measured. The results are noted in Table 3.

As indicated in Table 3, with the magnets of the comparison examples wherewith only an aluminum oxide coating film layer is provided on the surface of the Fe—B—R permanent magnets having the same magnetic properties, the deterioration in magnetic properties after corrosion tests wherein the test pieces were allowed to stand for 1000 hours under conditions of 80° C. temperature and 90% relative humidity was large and rusting also occurred. In contrast therewith, it is evident that the Fe—B—R permanent magnets of the present invention wherein the aluminum oxide coating film layer is provided with an Al or Ti coating film layer interposed between the aluminum oxide coating film and the magnet surface exhibited no rusting and the magnetic properties hardly changed at all.

TABLE 1

| | | Magnetic properties before corrosion resistance tests | | | | | |
|---|---|---|---|---|---|---|---|
| | | After aging treatment | | | After surface treatment | | |
| | | Br (kG) | iHc (kOe) | (BH)max (MGOe) | Br (kG) | iHc (kOe) | (BH)max (MGOe) |
| Embodiment 1 | 1 | 11.5 | 16.8 | 30.7 | 11.4 | 16.7 | 30.6 |
| | 2 | 11.4 | 16.8 | 30.6 | 11.4 | 16.6 | 30.6 |
| Embodiment 2 | 1 | 11.5 | 16.8 | 30.6 | 11.4 | 16.6 | 30.5 |
| | 2 | 11.5 | 16.8 | 30.7 | 11.4 | 16.7 | 30.6 |
| Embodiment 3 | | 11.5 | 16.8 | 30.7 | 11.4 | 16.6 | 30.6 |
| Comparison 1 | | 11.5 | 16.8 | 30.7 | 11.3 | 16.6 | 30.5 |
| Comparison 2 | | 11.5 | 16.8 | 30.7 | 11.4 | 16.6 | 30.5 |

TABLE 2

| | | | Magnetic | Arc ion plating conditions | | | |
|---|---|---|---|---|---|---|---|
| Embodiment | | Surface finishing | surface roughness (μm) | Gas pressure (Pa) | Bias voltage (V) | Time (min) | Coating thickness (μm) |
| 1 | 1 | Grinding to a mirror finish | 0.06 | 0.2 | −50 | 10 | 0.2 |
| | 2 | Grinding | 0.5 | 0.2 | −50 | 100 | 2.0 |
| 2 | 1 | Grinding to a mirror finish | 0.06 | 0.2 | −60 | 13 | 0.2 |
| | 2 | Grinding | 0.5 | 0.2 | −60 | 130 | 2.0 |

TABLE 3

| | | Magnetic properties before corrosion-resistance tests | | | | | | Surface state |
|---|---|---|---|---|---|---|---|---|
| | | After Corrosion resistance tests (1000 Hrs) | | | Percent deterioration in magnetic properties (%) | | | after corrosion resistance test |
| | | Br (kG) | iHc (kOe) | (BH)max (MGOe) | Br (kG) | iHc (kOe) | (BH)max (MGOe) | (State of deterioration) |
| Embodiment 1 | 1 | 11.4 | 16.5 | 30.0 | <1 | 1.8 | 2.3 | No change |
| | 2 | 11.3 | 16.4 | 29.9 | <1 | 2.4 | 2.3 | |
| Embodiment 2 | 1 | 11.4 | 16.4 | 29.8 | <1 | 2.4 | 2.6 | No change |
| | 2 | 11.4 | 16.4 | 29.8 | <1 | 2.4 | 2.9 | |
| Embodiment 3 | | 11.4 | 16.3 | 29.8 | <1 | 3.0 | 2.9 | No change |
| Comparison 1 | | 10.5 | 15.6 | 27.5 | 8.7 | 7.2 | 10.4 | Coating peeling |
| Comparison 2 | | 10.4 | 15.3 | 27.3 | 9.6 | 8.9 | 11.1 | Local rusting |

Percentage deterioration in magnetic properties=(Magnetic properties of finished starting materials)−(Magnetic properties after moisture resistance test)/(Magnetic properties of finished starting materials)×1000

INDUSTRIAL APPLICABILITY

In Fe—B—R permanent magnets according to the present invention, an aluminum oxide coating film layer is provided on the magnet surface with an Al or Ti coating film. As indicated in the embodiments, there was almost no deterioration in magnetic properties after being subjected to severe corrosion tests, particularly after being allowed to stand for 1000 hours under conditions of 80° C. temperature and 90% relative humidity. Hence the Fe—B—R permanent magnets according to the present invention are ideal for the high-performance, low-cost permanent magnets now most in demand.

In the fabrication method according to the present invention, after cleaning the surface of the Fe—B—R permanent magnet body by ion sputtering or the like, an Al or Ti coating film is formed on the surface of that magnet body by a vapor film-forming method such as ion plating, and then an aluminum oxide coating film is formed by a vapor film-forming method such as ion plating while introducing a rare gas containing $O_2$ . By forming the Al or Ti coating film on the magnet body surface, oxides on the surface of the magnet body are either partially or entirely reduced, and outstanding adhesiveness is exhibited between the magnet body surface and the Al or Ti coating film. By laminating the aluminum oxide coating film on the Al or Ti coating film, the adhesiveness of that coating film is sharply improved, outstanding corrosion resistance is exhibited, and the adhesiveness with the underlying layer becomes excellent even when allowed to stand for an extended time under atmospheric conditions of 80° C. temperature and 90% relative humidity. Due to the anticorrosive, wear-resistant, and electrically insulating properties of the anticorrosive metallic coating film applied, Fe—B—R permanent magnets are obtained which exhibit stable magnetic properties.

What is claimed is:

1. An anticorrosive permanent magnet which comprises:

an Fe—B—R base member;

an outer layer over said Fe—B—R base member composed of aluminum oxide and having a thickness of between 0.1 and 10 μm, and an intermediate layer between said Fe—B—R base member and said aluminum oxide outer layer, said intermediate layer being composed of Al and having a thickness of 0.06 to 30 μm.

2. An anticorrosive permanent magnet according to claim 1, wherein said aluminum oxide outer layer includes amorphous areas.

3. An anticorrosive permanent magnet according to claim 1, including an interface between said outer layer and said intermediate layer which is composed of AlOx, where $0<x<1$.

4. An anticorrosive permanent magnet which comprises:

an Fe—B—R base member;

an outer layer over said Fe—B—R base member composed of aluminum oxide and having a thickness of between 0.1 and 10 μm, and an intermediate layer between said Fe—B—R base member and said aluminum oxide outer layer, said intermediate layer being composed of Ti and having a thickness of 0.06 to 30 μm.

5. An anticorrosive permanent magnet according to claim 4, wherein said aluminum oxide outer layer includes amorphous areas.

6. An anticorrosive permanent magnet according to claim 4, including an interface between said outer layer and said intermediate layer which is composed (Ti—AL)Ox, where $0x\ x<1$.

7. A method of making an anticorrosive permanent magnet which comprises the steps of:

(a) providing an Fe—B—R permanent magnet base member, (b) cleaning a surface of said base member, (c) vapor depositing a layer of Al or Ti on said cleaned surface of said base member to a thickness of between 0.06 and 30 μm, and (d) vapor depositing a layer of aluminum oxide on said layer of Al or Ti to a thickness of 0.1 to 10 μm in an oxygen-containing gas atmosphere.

8. The method according to claim 7, wherein step (d) is conducted in an atmosphere of pure oxygen or a mixture of rare gas and at least 10% oxygen.

9. The method according to claim 7, wherein in steps (c) and (d) said vapor depositing is an ion plating process or a reaction ion plating process.

10. The method according to claim 7, wherein step (b) comprises ion sputtering and (d) comprises ion plating said Al or Ti on said cleaned surface.

* * * * *